US007595290B2

(12) United States Patent
Pounds et al.

(10) Patent No.: US 7,595,290 B2
(45) **Date of Patent: *Sep. 29, 2009**

(54) WATER-SOLUBLE STRETCHABLE POUCHES CONTAINING COMPOSITIONS

(75) Inventors: Thomas John Pounds, Cambridge (GB); Nigel Patrick Somerville-Roberts, Newcastle-Upon-Tyne (GB); Wayne Robert Fisher, Cincinnati, OH (US); Vernon Sanford Ping, III, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 69 days.

This patent is subject to a terminal disclaimer.

(21) Appl. No.: 10/278,653

(22) Filed: Oct. 23, 2002

(65) Prior Publication Data

US 2003/0050210 A1 Mar. 13, 2003

Related U.S. Application Data

(63) Continuation of application No. PCT/US01/07776, filed on Mar. 9, 2001.

(30) Foreign Application Priority Data

Apr. 28, 2000 (GB) ..... 0010220.2
Sep. 15, 2000 (GB) ..... 0022667.0

(51) Int. Cl.
*C11D 17/00* (2006.01)

(52) U.S. Cl. ..... 510/295; 510/296; 510/297; 510/299; 510/439

(58) Field of Classification Search ..... 510/293, 510/295, 296, 438, 297; 15/209.1; 428/35.2; 526/264, 330
See application file for complete search history.

(56) References Cited

U.S. PATENT DOCUMENTS

| | | | | | |
|---|---|---|---|---|---|
| 4,626,372 | A | * | 12/1986 | Kaufmann et al. | 510/296 |
| 5,429,874 | A | * | 7/1995 | VanPutte | 428/522 |
| 6,037,319 | A | * | 3/2000 | Dickler et al. | 510/439 |
| 6,136,776 | A | * | 10/2000 | Dickler et al. | 510/439 |
| 2002/0086806 | A1 | * | 7/2002 | Giblin et al. | 510/296 |

FOREIGN PATENT DOCUMENTS

| | | | |
|---|---|---|---|
| EP | 0 608 910 | A1 | 8/1994 |
| GB | 2 355 269 | A | 4/2001 |
| JP | 19940089647 | | 4/1994 |
| WO | WO 94/04656 | * | 3/1994 |

* cited by examiner

*Primary Examiner*—Necholus Ogden, Jr.
(74) *Attorney, Agent, or Firm*—Julie A. McConihay; Armina E. Matthews; Kim William Zerby

(57) ABSTRACT

The present invention relates to free-flowing compositions in a pouch having one or more compartments. The compartment and preferably the pouch as a whole are made from stretchable material, typically an elastic film which is water-soluble. The compositions are preferably cleaning compositions or fabric care compositions, in particular laundry or dish washing compositions.

17 Claims, No Drawings

WATER-SOLUBLE STRETCHABLE POUCHES CONTAINING COMPOSITIONS

CROSS REFERENCE TO RELATED APPLICATIONS

This is a continuation of International Application PCT/US01/07776 with an international filing date of Mar. 9, 2001, published in English under PCT Article 21(2) which claims benefit of Great Britain Application No. 0022667.0, filed Sep. 15, 2000; and Great Britain Application No. 0010220.2, filed Apr. 28, 2000

TECHNICAL FIELD

The present invention relates to compositions in a pouch having a compartment enclosing a component, the compartment being formed from a stretched material of non-uniform thickness.

BACKGROUND OF THE INVENTION

Cleaning compositions nowadays come in a number of product forms, such as granules, liquids and tablets, each form having its advantages and disadvantages.

Recently, tablets have gained renewed interest, mainly because they are easy to handle for the consumer and easy to dose ('unit dose'). To make tablets storage stable and to prevent breakage of the tablets during handling, the ingredients need to be strongly compressed together and generally binding agents are needed to ensure the tablets do not break. This can reduce their solubility and dispersibility which is undesirable for the consumers, both from a performance point of view and from a machine or fabric residue point of view.

Thus, alternative ways and better ways to provide easy to handle, unit dose products which do not dust or break, but dissolve complete and fast, are desirable.

The inventors have now found an improved method to make a product addressing the above problems, namely by incorporating a product, in particular solid products, in a (partially) water-soluble or -disintegrating or -dispersable pouch in a specific way, such that the above requirements are fulfilled.

Pouches for detergents as such are known in the art to be useful to provide unit dose compositions to be delivered to the wash. They typically are described as bag-shape pouches, loosely containing the product. These pouches can be made of water permeable material or water-soluble material. However, the solubility of these pouched products is not always satisfactory.

The inventors have now found improved pouched compositions with improved dissolution, namely pouched compositions having a compartment made from stretchable water-soluble, water-dispersible or water-disintegrating material of non-uniform thickness, this material being stretched around the particulate component (of the composition) in the compartment. The component of the compositions, and preferably the composition as a whole, is thus typically tightly enclosed in the compartment. Preferred is that at least one component or preferably the composition as a whole is particulate. This way of incorporating the component in a compartment (and of incorporating a composition in a pouch) results in an improved and/or controlled dissolution in water, e.g. faster and/or more complete, time-controlled, whilst the pouched composition is storage stable. It is believed that due to the compartment having a non-uniform thickness and being tightly pressed against the component or composition as a whole, the water penetrates through or dissolves quickly the compartment material, in particularly the thinnest part thereof, whilst during storage the remaining of the material of the compartment is still suitable to protect the product against moisture.

Moreover, because the component is tightly enclosed, improved stability upon storage is achieved, because reduced interaction of the ingredients in the component is achieved, similar to compacted tablets. When the component or the composition as a whole is particulate and incorporated by the method of the invention, the component and also the composition remains free-flowing, unlike tablets, and therefor, the dissolution of the components, and composition, into the wash water is much better.

Furthermore, improved process are provided to form the pouched composition as described above, such that the component of the composition is enclosed by a stretched, non-uniform compartment material.

SUMMARY OF THE INVENTION

The present invention provides a liquid or solid composition in a pouch, the pouch comprising one or more compartments and the composition one or more components, the compartment being formed from a stretchable water-disintegrating, water-soluble or water-dispersable material of non-uniform thickness.

Preferably, the composition comprising a particulate component, incorporated in a compartment.

The non-uniform thickness of the compartment material provides very rapid and/ or controlled release of component into water, whilst still ensuring storage stability of the pouched composition or component thereof.

In particular, the composition in a pouch of the invention is obtainable by a process comprising the steps of:

a) stretching a stretchable material, preferably a film, forming an open compartment, preferably by introducing the material in a mould and stretching the material into the mould to form the open compartment in the shape of the mould;

b) introducing a component, preferably a particulate component, in the open compartment, such that at least 95% of the volume of the open compartment is filled with the component;

c) subsequently closing the open compartment.

Typically, in step b) the open compartment is filled 100% or even overfilled with the particulate component, and when closing the open compartment, the material thereof remains stretched or is further stretched.

The component is typically tightly packed so that the density of the particulate component is increased, i.e. so that the density of the component after closing the compartment is higher than the bulk density of the component prior to incorporation in the compartment, whilst the still free-flowing, which can be noted when the pouch is removed. This enables more component to be contained in the volume of the pouch, gives the pouch a more pleasing aesthetic appeal to consumers, enables the pouch to be more easily handled by consumers without deforming the shape of the pouch.

The composition in the pouch is preferably such that the bulk density of the composition after closing the compartment is 5% to 45% or even to 35%, or it may be preferred that this is 5% to 30% or even 10% to 25% higher than the average of the bulk density of the (particulate) component(s) prior to introduction into the compartment.

Preferably, the pouch as a whole is water-soluble. Preferably the composition is a cleaning composition.

The invention also provides processes for making the pouched compositions of the invention, including the process described above.

DETAILED DESCRIPTION OF THE INVENTION

Pouch and Compartment Thereof

The pouch herein comprises a closed structure enclosing a volume space which comprises the composition. Thus, the pouch can be of any form, shape and material which is suitable to hold the composition prior to use, e.g. without allowing the release of the composition from the pouch prior to contact of the pouched composition to water. The exact execution will depend on for example the type and amount of the composition in the pouch, the number of compartments in the pouch, the characteristics required from the pouch to hold, protect and deliver or release the compositions.

The pouch may be of such a size that it conveniently contains either a unit dose amount of the composition herein, suitable for the required operation. For example, when the composition is a cleaning composition, the amount in the pouch can be such that it is suitable for one wash, or only a partial dose, to allow the consumer greater flexibility to vary the amount used, for example when the pouched composition is a detergent composition, it may depend on the size and/or degree of soiling of the wash load.

In one preferred embodiment, the pouched composition has a clearly distinguishable top side and bottom side. Preferably, the pouched composition is formed in a mould with a round or flat bottom and circular walls. Thus, preferred is also that the pouched composition is a spheroid or more preferably cylinder-shaped.

The pouch has one or more compartments, whereof preferably at least one contains a particulate component. In one execution, more than one particulate component is present and all particulate components are present in one and the same compartment of the pouch.

It may be preferred that one or more compartments for liquid component(s) are present in addition to the compartment(s) comprising the particulate component (s).

However, it may be preferred that there is only one compartment in the pouch, thus containing the composition as a whole. This reduces the material needed to form the compartment and pouch.

The compartment of the pouch herein also has a closed structure made of a material as described herein, enclosing a volume space, holding the component. Thus, the compartment is made such that it is suitable to hold the component prior to use, e.g. without allowing the release of the components from the compartment prior to contact of the pouched composition to water. The compartment can have any form or shape, depending on the nature of the material of the compartment, the nature of the component or composition, the intended use, amount of the component etc. If more than one compartment is present, the compartments are linked or connected to one another by any means, for example sealed by heat sealing or by wetting sealing, glued by any known glue material, as also described hereinafter.

The compartment is made of water-dispersable, water-disintegrating or preferably water-soluble material, preferably a film material which is stretchable. Preferably, the pouch as a whole is made of a material which is stretchable. This stretchable material is stretched to form the open compartment shape which is filled for more than 95% by volume or even 100% or even over filled. Moreover, the material is preferably elastic, to ensure the tight packing and to ensure no (additional) head space can be form after closure of the compartment.

Preferred stretchable materials have a maximum stretching degree of at least 150%, preferably at least 200%, more preferably of at least 400% as determined by comparison of the original length of a piece of material with the length of this piece of material just prior to rupture due to stretching, when a force of at least 1 Newton is applied. Preferably, the material is such that it has a stretching degree as before, when a force of at least 2Newton, or even at least 3 Newton is used. Preferably, it has this stretching degree when a force of the above lower limits is used, but not more than 20 Newton, or even 12 Newton, or even 8 Newton.

For example, a piece of film with a length of 10 cm and a width of 1 cm and a thickness of 40 microns is stretched lengthwise with a force of for example 2.8 Newton and thus an increasing stress, up to the point that it ruptures. The extent of elongation just before rupture can be determined by continuously measuring the length and the degree of stretching can then be calculated. For example, this piece of film with an original length of 10 cm can be stretched with a force of 2.8 Newton to 52 cm (just before rupture) and thus has a maximum stretching degree of 520% (at a force of at least 2 Newton, namely 2.8 Newton).

The force to stretch such a piece of film (10 cm×1 cm×40 microns) to a degree of 200% should preferably be at least 1 Newton, preferably at least 2 Newton, more preferably at least 2.5 or even 3 Newton, and preferably no more than 20 Newton, preferably less than 12 Newton, most preferably less than 8 Newton. This in particular ensures that the elastic force remaining in the film after forming is high enough to immobilize the powders within the pouch, but not too high to easily mould and form a pouch from it.

As is clear form the definition herein, the stretchable material is defined by a degree of stretching measured when it is not present in the closed compartment. However, as said above, the material is stretched when forming the compartment. This can for example been seen by printing a grid onto the material, e.g. film, prior to stretching, then forming a compartment with the component from this material with grid. It can be seen that squares of the grid are elongated and thus stretched.

The elasticity of the stretchable material of the compartment and preferably the pouch as a whole is herein typically defined as the 'elasticity recovery'. This can be determined by stretching the material (for example to an elongation of 200%, as set out above) and measuring the length of the material after release of the stretching force. For example a piece of film of a length of 10 cm and width 1 cm and thickness of 40 microns is stretched lengthwise to 20 cm (200% elongation) with a force of 2.8 Newtons (as above), and then the force is removed. The film snaps back to a length of 12 cm, which means 80% elastic recovery.

The elasticity of the pouch material referred to herein, is the elasticity at the time of making the pouch. Prolonged stretching, for example that typically occurs during storage of the pouch, will decrease the elasticity of the pouch material due to plastic creeping. It is preferred that at the time of making the pouch or compartment thereof, the compartment material has an elasticity such that the elastic, recovery is from 20% to 100%, more preferably from 50% or from 60% or more preferably from 75% or even 80% to 100%.

Thus, the material of the compartment (and preferably the pouch as a whole) is stretched during formation and/or closing of the compartment or pouch, such that the resulting pouched composition has a compartment or pouch which is at least partially stretched. The stretching of the material of the compartment when forming the compartment may be done by any means for example by applying a force on the material, including the use of an vacuum, optionally while heating the material.

Typically and preferably, the degree of stretching is non-uniform over the compartment or pouch, due to the formation and closing process. For example, when a film is positioned in a mould and an open compartment is formed by vacuum forming (and then filled with the components and then closed) the part of the film in the bottom of the mould, furthest removed form the points of closing, will be stretched more than in the top part. The material of the compartment has typically a thickness variation from 10% to 1000%, preferably 20% to 600%, or even 40% to 500% or even 60% to 400%. This can be measured by any method, for example by use of an appropriate micrometer. This can be measured with a pair of calipers such as available form Mitutoyo Uk Ltd, under no. CD-6"CP.

Therefor, it may be preferred that the component to be delivered first to the water is comprised in a bottom layer of the compartment, and a component which is to be delivered to the water at a later stage is comprised in a subsequent layer, closer to the top of the compartment. Alternatively, or in addition, it may be preferred that the least moisture sensitive component is comprised in the bottom layer of the compartment and a more moisture sensitive component is comprised in a subsequent or top layer.

Material of Pouch and Compartment

Preferably, the composition is a composition to be delivered to water and thus, the pouch and the compartment (s) thereof are designed such that at least one or more of the components is released at, or very shortly after, the time of addition to the water. Thus it is preferred that the compartment and preferably the pouch is formed from a material which is water-dispersible or more preferably water-soluble. In one preferred embodiment, the component is delivered to the water within 3 minute, preferably even within 2 minutes or even within 1 minute after contacting the pouched composition to water.

Preferred water-dispersable material herein has a dispersability of at least 50%, preferably at least 75% or even at least 95%, as measured by the method set out hereinafter using a glass-filter with a maximum pore size of 50 microns. More preferably the material is water-soluble and has a solubility of at least 50%, preferably at least 75% or even at least 95%, as measured by the method set out hereinafter using a glass-filter with a maximum pore size of 20 microns, namely:

Gravimetric method for determining water-solubility or water-dispersability of the material of the compartment and/or pouch: 10 grams±0.1 gram of material is added in a 400 ml beaker, whereof the weight has been determined, and 245ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 20 or 50 micron). The water is dried off from the collected filtrate by any conventional method, and the weight of the remaining polymer is determined (which is the dissolved or dispersed fraction). Then, the % solubility or dispersability can be calculated.

Preferred materials are polymeric materials, preferably polymers which are formed into a film or sheet. The material in the form of a film can for example be obtained by casting, blow-molding, extrusion or blow extrusion of the polymer material, as known in the art.

Preferred polymer copolymers or derivatives thereof are selected from polyvinyl alcohols, polyvinyl pyrrolidone, polyalkylene oxides, (modified) cellulose, (modified)cellulose-ethers or -esters or -amides, polycarboxylic acids and salts including polyacrylates, copolymers of maleic/acrylic acids, polyaminoacids or peptides, polyamides including polyacrylamide, polysaccharides including starch and gelatine, natural gums such as xanthum and carragum. Preferably, the polymer is selected from polyacrylates and acrylate copolymers, including polymethacrylates, methylcellulose, sodium carboxymethylcellulose, dextrin, maltodextrin, ethylcellulose, hydroxyethyl cellulose, hydroxypropyl methylcellulose,; most preferably polyvinyl alcohols, polyvinyl alcohol copolymers and/or hydroxypropyl methyl cellulose (HPMC).

The polymer may have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA (or a copolymer thereof) and/or HPMC of a weight average molecular weight of 10,000-40,000, preferably around 20,000, and of PVA (or copolymer thereof) and/or HPMC with a weight average molecular weight of about 100,000 to 300,000, preferably around 150,000.

Iso useful are polymer blend compositions, for example comprising hydrolytically degradable and water-soluble polymer blend such as polylactide and polyvinyl alcohol, achieved by the mixing of polylactide and polyvinyl alcohol, typically comprising 1-35% by weight polylactide and approximately 65-99 by weight polyvinyl alcohol, if the material is to be water-dispersable, or water-soluble.

It may be preferred that the polymer present in the material of the compartment is from 60-98% hydrolised, preferably 80% to 90%, to improve the dissolution of the material.

Most preferred are materials which are water-soluble stretchable and elastic material comprising PVA polymer having properties such as the PVA films sold under the trade reference M8630, as sold by Chris-Craft Industrial Products of Gary, Ind., U.S.

Preferably, the level of a type polymer (e.g. commercial mixture) in the film material, for example PVA polymer, is at least 60% by weight of the material or film, preferably at least 60% or even at least 70% or even at least 80 or 90%. The upper level is up to 100%, but typically 99% or even 98% by weight.

The material herein may comprise other additive ingredients then the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the pouched composition is a detergent composition, that the pouch or compartment material itself comprises a detergent additive to be delivered to the wash water, for example organic polymeric soil release agents, dispersants, dye transfer inhibitors.

The material in the form of a film may be coated, preferably only one-sided, with any coating method and with any coating agent, depending on the required properties; for example, it may be beneficial to coat the film such that the compartment or pouch or composition therein, is more storage stable and/or less sensitive to moisture and/or acts as a improved moisture barrier.

A very useful form is to coat the material or film on one side with a coating that slows the dissolution of the film, prior to forming of the compartment and thus prior to stretching the material or film. Then, by stretching the material or film, the coating is stretched as well, resulting in cracks in the coating and/or uneven distribution of the coating over the material and thus over the compartment. This then ensures still stability against moisture during storage, whilst the presence of cracks or the uneven distribution still ensures the required dissolution in use. Hence it is possible to make a pouched composition that is resistant to being handled with wet fingers when it is picked up at the sides but will still release product rapidly when it is immersed in water due to film rupture at the thinnest points.

Any coating material can be used, particular useful are hydrophobic coatings, or polymers with a low water-solubility, lower then defined herein before.

The compartment material may be shrinkable material, so that the surface area can be reduced during or subsequent to closing the open compartment by shrinking the material.

Preferably, the open compartment is closed with a piece of the same material as the material of the open compartment. The closing material, and thus preferably also the open compartment material or shape material, is preferably thermoplastic so that it can be closed by heat-sealing. Alternatively, a thermoplastic coating may be provided, either over the whole material or just in the areas where seals are to be formed. The sealing can also be made by solvent welding or wetting sealing. Suitable heat-sealable materials include polyvinyl alcohol, polyvinyl acetate, polyvinyl pyrrolidone, polyethylene oxide, acrylic resins and mixtures thereof, in particular polyvinyl alcohols.

Compositions and Components Thereof

The composition of the invention is present in a pouch and is herein also referred to as pouched composition. The composition comprises preferably at least one particulate component, in particular because the open compartment can then be overfilled with particulate component and then closed, to increase the stretching of the film and the tight packing and even density increase. Generally, the particulate component is a powder, granular, extrudate or flake component. Preferably the composition is in the form of free-flowing powder. Preferably, the composition or component thereof is not in the form of a tablet. Preferred are cleaning compositions, such as laundry detergents, dish washing detergent, and fabric care compositions such as conditioners and other rinse additives.

The pouched composition herein is obtainable by a method whereby the component is introduced in the open compartment (preferred processes herefor being described below) such that the open compartment is almost completely filled, typically such that at least 95% of the volume of that open compartment (shape), preferably at least 98% or (in particular when the component is particulate) even at least 100% of the open compartment shape is filled, prior to closing said open compartment shape. More preferably, the open compartment (shape) is overfilled with the particulate components, i.e. that the volume of the components is more than 100% of the volume of the shape, preferably more than 105% or more preferably more than 110% or even more than 15%.

The composition in the pouch herein can for example be obtainable by a process involving:

a) stretching a stretchable material, preferably a film, thereby forming an open compartment, preferably by introducing the material in a mould and stretching the material into the mould to form the compartment in the shape of the mould;

b) introducing a (particulate) component in the open component, such that at least 95% but preferably at least 100% of the volume of the open compartment is filled with the particulate component;

c) subsequently closing the open compartment.

In one preferred process, step a), or b) and c) of the process above may be performed under reduced pressure, lower than atmospheric pressure, preferably by applying a vacuum, so that after filling and closing under reduced pressure or vacuum, a tightly packed compartment is obtained.

The compartment can be closed by further stretching the material and closing the compartment, but preferably the open compartment is closed with an additional piece of material, which may be the same type of material. Preferably, the open compartment and the closing material are both films of stretchable material, preferably both water-soluble materials. They can then be sealed together by any means, to ensure closure of the compartment, for example by wet welding or more preferably heat sealing.

Typically, the incorporation of the particulate component into the compartment is such that the bulk density of component after closing the compartment is increased with 5% to 45% preferably to 35%, preferably 5% or even 10% to 30% or even to 25%, or even 8% to 20% or even to 15%, compared to the bulk density of the component prior to incorporation in the compartment.

The bulk density of a component prior to incorporation in the pouched composition can be determined by the Repour Cup method, as described in ISO 3424-1975-E.

The bulk density of the component after closing of the compartment can be determined by a method of volume displacement. For example, a vessel with a wide neck and an off-take arm is filled with a solvent of known density, which must not affect the compartment material, up to the level of the collecting arm. The component in the compartment to be tested is accurately weighed and then immersed in the liquid, for example by using a piece of thin metal wire. The amount of liquid that is displaced is the liquid leaving the vessel through the arm and this is collected and carefully weighed. The replaced volume of displaced liquid is easily calculated from this weight and the known density of the liquid. Then, the volume replacement due to the material of the compartment (rather than the component therein) can be measured or calculated. The volume replacement is measured within 5 minutes of immersing the pouch in the liquid. This is deducted from the volume replacement as measured in the above test, to obtain the volume replacement of the actual component. The density of the component as it is in the closed compartment can then be calculated. (Errors associated with the thin wire used to immerse the pouch are minor and are not taken into account.) Depending on the material of compartment, a suitable liquid can be selected. For example, for water-soluble material such as PVA, preferred liquid is glycerol or Neodol 23-5. This is because the compartment may contain microscopic pinholes in the film as a result of the stretching. Using a viscous solvent such as glycerol will minimize any errors due to liquid seeping into the pouch. Also useful are nonionic surfactants such as Neodol 23-5.

The tight packing can be done by increasing the packing efficiency and reducing space between the particles of the component, for example by vibration of the components in the open compartment, allowing the component particles to settle for a period of time, modestly increasing pressure provided that the component and typically the composition as a whole remains free-flowing, for example by applying a pressure of up to 20 Mpa, preferably up to 10 Mpa or more preferably up to 5 Mpa or even up to 2 MPa, if any pressure is used.

If the component is in particulate form, then the bulk density of the component can be achieved by a compaction step. Typically, the particulate component is first placed in the open compartment, and then a pressure is exerted on said component causing the bulk density of said component to increase from 5% to 50%, preferably from 10% or from 15% or from 20%, and preferably to 45%, or to 40%, or to 35%, or to 30% of the original bulk density of the component prior to the compaction step.

The pressure may be exerted in the form of a solid body, which is typically of a size and shape that is capable of fitting into the opening of the open compartment. The solid body is capable of applying pressure to said component. Preferably, the solid body applies a pressure of up to 20 Mpa, preferably up to 10 Mpa or more preferably up to 5 Mpa or even up to 2 MPa, to the particulate component.

In a preferred embodiment of the present invention, an indent is formed in the particulate component, preferred by contact of a solid body to the particulate component, even more preferably the indent is formed during the compaction step. This indent is particular beneficial if the pouch formed is in the form of a multi-compartment pouch, and comprises a first compartment and a second compartment. The particulate component having the indent formed therein, is typically contained in the first compartment. The indent of the first compartment allows the second compartment to be more easily joined to the first compartment, and reduces the complexity and difficulty of the process for forming the multi-compartment pouch and increases the stability and structural strength of the multi-compartment pouch.

It may be preferred that the composition in the pouch comprises different components, for example more than one particulate component or liquid component, or mixtures thereof. Then, it may be preferred that the different components are comprised in different compartments, and it may be preferred that the thickness of the material of one compartment is different to another compartment, so that controlled or sequential release of the component therein can be achieved.

When used herein, 'different' component means that one component has at least one different chemical property, for example at least one different ingredient, than the other component or components, or one component has at least one different physical property than another component or component. Examples are described herein after.

The composition and the component herein can be any composition, in particular any free-flowable granular or powder composition to be delivered to water, and active in water.

Preferred compositions are beverages, edible compositions, pharmaceutical compositions, personal care compositions, cleaning compositions, fabric care or conditioning compositions; most preferably, the compositions herein are cleaning compositions or fabric care compositions, preferably hard surface cleaners, more preferably laundry or dish washing compositions, including detergents, pretreatment or soaking compositions or fabric conditioners, and other rinse additives.

When used in cleaning compositions the component can contain any active cleaning ingredient. In particular preferred are active ingredients such as surfactants, chelating agents, builders, enzymes, perfumes, bleaches, bleach activators, fabric softeners, fabric conditioners, antibacterial agents, effervescence sources, brighteners, photo-bleaches.

Fabric care compositions or rinse additives preferably comprise at least one or more softening agents, such as quaternary ammonium compounds and/or softening clays, and preferably additional agent such as anti-wrinkling aids, perfumes, chelants, fabric integrity polymers.

Generally, water is present in the component at a level of up to 10%; in particular when the component is particulate, the level of water is preferably from 0.2% to 5% or even 0.2% to 3% or even form 0.5% to 2% by weight of the component.

Although the nature of the pouched composition is such that it readily dissolves or disperses into the water, it may be preferred that disintegrating agents such as effervescence sources, water-swellable polymers or clays are present in the pouch or compartment material it self, and/or in the composition therein, in particular effervescence sources based on an acid and a carbonate source. Suitable acids include the organic carboxylic acids such as fumaric acid, maleic acid, malic acid, citric acid; suitable carbonate sources include sodium salts of carbonate, bicarbonate, percarbonate. Preferred levels for the disintegrating aids or effervescence sources or both are from 0.05% to 15% or even from 0.2% to 10% or even form 0.3 to 5% by weight pouched composition.

The particulate component comprises preferably at least one particulate compound, but typically the component comprises at least two particulate compounds, preferably thoroughly mixed to form the component. Because the component in the compartment of the pouch is tightly packed, the interaction between the different ingredients is reduced. This allows the incorporation in a component of even incompatible ingredients, if required. Thus, the component may comprise one or more enzymes and a bleach such as a peroxygen bleach, such as a salt of percarbonate. It may however be beneficial to include the bleaching agents, but in particular the peroxygen bleach, in a different component than the enzymes and/or other hygroscopic materials or anhydrous or hydratable materials including overdried materials such as aluminosilicates, anhydrous salts or acids.

When the pouched compositions is such that it has a clear top and bottom side and different component are present in the form of layers, it can also be beneficial to include in the bottom layer non-gelling detergent ingredients, such as water-soluble salts and acids, including for example effervescing salts and acids such as carbonate salts and organic carboxylic acids such as citric acid, and in a higher layer or the top layer potential gelling ingredients such as anionic and nonionic surfactants. At the bottom part, the compartment material is typically more stretched, which will lead to the bottom region to be dissolved prior to the top region of the pouched composition.

It may even be possible that part or all of the ingredients in particulate component are not pre-granulated, such as agglomerated, spray-dried, extruded, prior to incorporation into the compartment, and that the component is a mixture of dry-mixed powder ingredients or even raw materials. Preferred may be that for example less than 60% or even less than 40% or even less than 20% of the components are free-flowable pre-granulated granules Also, it has been found that it is beneficial for the cleaning performance, when the cleaning compositions herein or the material of the compartment or pouch, preferably both the composition and said material, comprise one or more chelating agents, in particular phosphonate- and/or carboxylate-containing chelating agents, in particular EDDS or EDTA or HEDP.

It has also been found that the presence in the wash water of high levels of certain dissolved compartment or pouch material having free hydroxy groups can have a negative effect on the removal of clay stains, under certain wash conditions. Therefore, it is not only beneficial to use as little compartment material as possible and thus to use preferably a pouch with only one compartment, but it has also been found that it is beneficial to incorporate in the composition or the pouch material a polyalkoxylated compound, preferably a polyalkoxylated alcohol, preferably having an average alcohol carbon chain length of 11 to 24, preferably 12 to 20 or even 14 to 18, and an average alkoxylation degree of at least 20 or even at least 40 or even at least 70. Highly preferred are from 0.1% to 8%, or even from 0.5 to 5% or even from 0.8% to 3% by weight of the pouched composition of such a compound; highly preferred is TAE80.

Another preferred ingredient is a perhydrate bleach, such as salts of percarbonates, particularly the sodium salts. It has been found that in when the pouch or compartment comprises a material with free hydroxy groups, such as PVA, the preferred bleaching agent comprises a percarbonate salt and is preferably free form any perborate salts, and also borate salts. The borates and perborates interact with these hydroxy-containing materials this can reduce the dissolution of the materials and may also result in reduced performance.

Preferred are also organic peroxyacid bleach precursor or activator compound, such as alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms such as tetraacetyl ethylene diamine (TAED), sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose, but also amide substituted alkyl peroxyacid precursor compounds.

Highly preferred ingredient for use herein are one or more enzymes. Preferred enzymes include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139. Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Preferred amylases include, for example, α-amylases obtained from a special strain of *B licheniformis,* described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US9703635, and in WO95/26397 and WO96/23873. The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Preferred are also anionic surfactants, which include salts (including, for example, sodium, potassium, ammonium, and substituted ammonium salts such as mono-, di- and triethanolamine salts) of the anionic sulfate, sulfonate, carboxylate and sarcosinate surfactant, preferably linear or branched alkyl benzene sulfonate, alkyl sulphates and alkyl ethoxylsulfates, isethionates, N-acyl taurates, fatty acid amides of methyl tauride, alkyl succinates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), N-acyl sarcosinates. Highly preferred is that when anionic surfactants are present, at least one alkyl sulphate surfactant is present, preferably a branched alkyl sulphate surfactant, preferably at a level of 1% to 20% or even to 15% by weight of the component or composition.

Also preferred are nonionic surfactants such as nonionic surfactant selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Cationic surfactants and softening agents may also be included herein, for example quaternary ammonium surfactants and softening agents, and choline ester surfactants.

Coloring agent such as iron oxides and hydroxydes, azo-dyes, natural dyes, may also be present in the composition or preferably in the compartment or pouch material, preferably present at levels of 0.001% and 10% or even 0.01 to 5% or even 0.05 to 1% by weight of the pouched composition.

EXAMPLES

Example 1

A piece of Chris-Craft M-8630 film, 38 microns thick, is placed on top of a mould and fixed in place. The mould consists of a cylindrical shape with a diameter of 45 mm and a depth of 25 mm. A 1 mm thick layer of rubber remains present around the edges of the mould. The mould has some holes in the mold material to allow a vacuum to be applied.

A vacuum is applied to pull the film into the mold and pull the film flush with the inner surface of the mould. 40 g of a detergent powder mix comprising percarbonate salt and water-soluble salts and organic acids, typically carbonate salts, citric acid and/or citrate, enzymes, bleach activator and surfactants is poured into the mould. This powder mix has a bulk density of 860 g/l prior to being poured into the mould. This is slightly vibrated. The mould is filled between 105% to 115%.

Next, a sheet of the same M-8630 film is placed over the top of the mould with the powder and sealed to the first layer of film by applying an annular piece of flat metal of an inner diameter of 46 mm and heating that metal under moderate pressure onto the ring of rubber at the edge of the mould, to heat-seal the two pieces of film together. The metal ring is typically heated to a temperature of 140-146 ° C. and applied for up to 5 seconds. The film is stretched during this process, which can be visualised by using in this example a film material with a grid on it. The thickness variation of the film is between 20 and 40 microns, the bottom being 20 microns, the top being 40 microns and the sides varying between 20 and 40 microns.

The bulk density of the pouched composition was then tested by the method described above and found to be 1020 g/l.

Pouches made by the above method released product on immersion in 5 liters of 10° C. water in less than 10 seconds.

A 10 cm×1 cm×40 microns piece of this film material itself was tested for elasticity and stretchability, using a 2.8Newton force, as described above. The maximum stretching degree was 520 and the elastic recovery was 85%.

Example 2

The example 1 is repeated, filling the open pouch in the mould first with 17.5 g of detergent component comprising 8 gram sodium percarbonate and 4 gram citric acid and 5.5 gram sodium carbonate and then 17.5 gram of a component comprising 0.1 gram enzymes, 5 gram anionic surfactant and 10 gram zeolite, 2.4 gram of perfume, bleach activator (TAED), brighteners, and other minor additives.

Example 3

The example 1 is repeated, filling the open pouch in the mould first with 30 g of detergent component comprising sodium percarbonate and citric acid and sodium carbonate enzymes anionic surfactant and zeolite, perfume, bleach activator (TAED), brighteners, and other minor additives as in example 2, the balance being sodium sulphate filler salts, and then a second layer of 5 gram of a fabric softening clay was added.

The following are detergent compositions which may also be suitable incorporated in a pouch of the invention:

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| branched or linear synthetic alkyl sulphate surfactant | — | — | 2.0 | 5.0 | 5.0 | | — | — | — |
| cationic surfactant | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| polyacrylic and/or polymaleic acid polymer, or salt | 1.0 | 2.0 | 11.0 | — | — | 2.0 | — | — | — |
| PEG 4000 | — | 2.0 | — | 1.0 | — | 1.0 | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| effervescence granule of 50% citric acid and 50% sodium carbonate | 10 | 7.0 | — | — | — | — | — | — | — |
| Agglomerate | | | | | | | | | |
| LAS | | | — | — | — | — | 2.0 | 2.0 | — |
| branched or linear synthetic alkyl sulphate surfactant | | | — | — | — | — | — | 4.0 | 4.0 |
| ethoxylated alkyl sulphate surfactant | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| Citric acid | | | — | — | — | 4.0 | — | 1.0 | 1.0 |
| SRP | | | — | — | — | 1.0 | 1.0 | 0.2 | — |
| Zeolite A | | | — | — | — | 15.0 | 26.0 | 15.0 | 16.0 |
| PEG | — | — | — | — | — | — | 4.0 | — | — |

-continued

| | A | B | C | D | E | F | G | H | I |
|---|---|---|---|---|---|---|---|---|---|
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| effervescence granule (as above) | — | 4.0 | 10.0 | 4.0 | 25 | 8.0 | 12.0 | 2.0 | 4.0 |
| TAED | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| sodium percarbonate | 15.0 | — | — | 10.0 | 15.0 | 5.0 | — | 11.0 | — |
| speckle | — | — | — | 0.3 | 0.05 | 0.1 | — | — | — |
| nonionic surfactant | — | 2.0 | 1.0 | — | 5.0 | 0.5 | — | 0.7 | — |
| Perfume | 1.0 | 0.5 | 1.1 | 0.8 | 0.3 | 0.5 | 0.3 | 0.5 | — |
| Citrate/citric acid | — | — | 20.0 | 4.0 | — | 5.0 | 15.0 | — | 5.0 |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Fillers up to 100% | | | | | | | | | |

What is claimed is:

1. A composition within a pouch, comprising:

a pouch having a compartment formed of a film material comprising a stretchable water-disintegrating polymer, stretchable water-soluble polymer, stretchable water-dispersible polymer, or a mixture thereof, wherein the stretched film material is of a non-uniform thickness varying from about 20 microns to about 40 microns;

a disintegrating aid in the film material, the disintegrating aid comprising an effervescent source that includes an organic acid and a carbonate source;

a detergent additive in the film material; and a detergent composition in the compartment, wherein:

the compartment prior to closure is more than 100% filled with the detergent composition, a bulk density of the detergent composition is increased 5-45% due to stretching the film material over the composition-overfilled compartment to close the compartment, and the disintegrating aid in the film material, the composition-overfilled compartment, and the non-uniform thickness of the film material enhance water solubility of the stretched film material.

2. A process for preparing the composition within the pouch according to claim 1, the process comprising:

a) forming the compartment in the shape of a mould by introducing and stretching a first sheet of the film material into the mould until the stretched first sheet of the film material is of a non-uniform thickness;

b) introducing the detergent composition into the compartment, such that the compartment is more than 100% filled with the detergent composition;

c) pressuring the detergent composition in the compartment by stretching a second sheet of the film material over the composition-overfilled compartment to increase the bulk density of the detergent composition 5-45%; and d) maintaining the increased bulk density of the detergent composition by sealing the stretched first and second sheets of the film material to close the composition over-filled compartment.

3. A composition within a pouch according to claim 1, wherein the film material has a maximum stretching degree of at least 200% and an elastic recovery of from 50% to 100%.

4. A composition within a pouch according to claim 1, wherein the compartment and the pouch are water-soluble.

5. A composition within a pouch according to claim 1, wherein the film material comprises a polyvinyl alcohol polymer.

6. A composition within a pouch according to claim 1, wherein the detergent composition comprises a laundry or dishwashing detergent.

7. A composition within a pouch according to claim 1, wherein the detergent composition comprises at least one surfactant.

8. A composition within a pouch according to claim 1, wherein the disintegrating aid comprises an effervescence source, clay, or a combination thereof.

9. A composition within a pouch according to claim 1, wherein the organic acid comprises fumaric acid, maleic acid, malic acid, citric acid, or a combination thereof.

10. A composition within a pouch according to claim 1, wherein the carbonate source comprises sodium salt of carbonate, sodium salt of bicarbonate, sodium salt of percarbonate, or a combination thereof.

11. A process for preparing a composition within a pouch according to claim 2, wherein at least one of the first and second sheets of the film material are shrinkable and the step d) of maintaining the increased bulk density of the detergent composition by sealing the stretched first and second sheets of the film material to close the composition over-filled compartment comprises shrinking at least one of the first and second sheets of the film material by heat shrinking to reduce a surface area thereof during or subsequent to sealing the first and second sheets of the film material to close the composition over-filled compartment.

12. A process for preparing a composition within a pouch according to claim 2, wherein at least one of step a), b), c), and d) are performed under reduced pressure that is lower than atmospheric pressure.

13. A process for preparing a composition within a pouch according to claim 12, wherein the reduced pressure is effected by means of applying a vacuum.

14. A process for preparing the composition within the pouch according to claim 1, the process comprising:

a) forming the compartment in the shape of a mould by introducing and stretching a first portion of the film material into the mould until the stretched first portion of the film material is of a non-uniform thickness varying from about 20 microns near a bottom of the mould to about 40 microns near a top of the mould;

b) introducing the detergent composition into the compartment, such that the compartment is more than 100% filled with the detergent composition;

c) pressuring the detergent composition in the compartment by stretching a second portion of the film material over the composition-overfilled compartment to increase the bulk density of the detergent composition 5-45%; and d) maintaining the increased bulk density of the detergent composition by sealing the stretched first and second portions of the film material to close the composition over-filled compartment.

15. A composition within a pouch according to claim 1, wherein the detergent additive is an organic polymeric soil release agent.

16. A composition within a pouch according to claim 1, wherein the detergent additive is a dispersant.

17. A composition within a pouch according to claim 1, wherein the detergent additive is a dye transfer inhibitor.

* * * * *